US007479021B2

(12) United States Patent
Huang

(10) Patent No.: US 7,479,021 B2
(45) Date of Patent: Jan. 20, 2009

(54) USB COPY-RESISTANT PLUGGING-AND-LOCKING DEVICE

(75) Inventor: Chien-Pin Huang, Taipei (TW)

(73) Assignees: Guann Tau International Corp., Taipei (TW); Jin Chyun Mei Enterprises Co., Ltd., Taipei Hsien (TW)

( * ) Notice: Subject to any disclaimer, the term of this patent is extended or adjusted under 35 U.S.C. 154(b) by 0 days.

(21) Appl. No.: 11/790,291

(22) Filed: Apr. 24, 2007

(65) Prior Publication Data

US 2008/0057785 A1 Mar. 6, 2008

(30) Foreign Application Priority Data

Apr. 26, 2006 (TW) ..... 95207128 U

(51) Int. Cl.
*H01R 13/44* (2006.01)

(52) U.S. Cl. ..... 439/133; 439/135; 70/57; 70/58

(58) Field of Classification Search ..... 439/133, 439/135, 148, 353, 372; 70/14, 57–58
See application file for complete search history.

(56) References Cited

U.S. PATENT DOCUMENTS 4,764,129 A * 8/1988 Jones et al. ..... 439/677
5,212,729 A * 5/1993 Schafer ..... 705/55
6,671,808 B1 * 12/2003 Abbott et al. ..... 726/4
6,991,479 B2 * 1/2006 Miao ..... 439/133
7,056,149 B1 * 6/2006 Lanni ..... 439/488
7,104,814 B1 * 9/2006 She et al. ..... 439/131
7,128,586 B2 * 10/2006 Kung ..... 439/133
7,275,941 B1 * 10/2007 Bushby ..... 439/133
2003/0220002 A1 * 11/2003 Chen ..... 439/133
2003/0224637 A1 * 12/2003 Ling ..... 439/133
2005/0130469 A1 * 6/2005 Ikenoue ..... 439/131
2005/0176308 A1 * 8/2005 Gurreri ..... 439/680
2005/0202698 A1 * 9/2005 Miao ..... 439/133
2005/0245132 A1 * 11/2005 Huang et al. ..... 439/607
2006/0094302 A1 * 5/2006 Lord ..... 439/680
2006/0234533 A1 * 10/2006 Lei et al. ..... 439/135
2007/0020976 A1 * 1/2007 Tirtosupono ..... 439/133
2007/0037452 A1 * 2/2007 Martin et al. ..... 439/638
2007/0162655 A1 * 7/2007 Huang ..... 710/36
2008/0026614 A1 * 1/2008 Emerson et al. ..... 439/136
2008/0041125 A1 * 2/2008 Poppe ..... 70/57

* cited by examiner

*Primary Examiner*—Renees Luebke
*Assistant Examiner*—Larisa Tsukerman
(74) *Attorney, Agent, or Firm*—WPAT. P.C.; Justin King

(57) ABSTRACT

A USB copy-resistant plugging-and-locking device having an end contacts a USB guided seat is capable of performing displacement movement along the extended direction of the USB guided seat. The USB guided seat has several guided slots, each of the guided slots provides a depth "d" at an end of the USB guided seat (3), and the several guided slots has at least a dimension specification. The USB copy-resistant plugging-and-locking device includes a housing for containing the USB guided seat and a plurality of alignment portions positioning on the housing and appearing as a predetermined arrangement. Each of the alignment portions is one-to-one correspondent to the several guided slots making the USB guided seat place into the containing space when the USB copy-resistant plugging-and-locking device performs a displacement movement along the extended direction of the USB guided seat.

6 Claims, 5 Drawing Sheets

USB COPY-RESISTANT PLUGGING-AND-LOCKING DEVICE

BACKGROUND OF THE INVENTION

1. Field of the Invention

The invention relates to a USB copy-resistant plugging-and-locking device, and more particularly, to a USB copy-resistant plugging-and-locking device that is capable of preventing the data from being stolen by adding a cipher code through the data transmission of USB port.

2. Description of the Prior Art

Science and technology change with each passing days. Following the popularization of the personal computer as well as the flourishing of the 3C-product, the peripherals having various specifications, components such as joints, plugging heads, and signal cables having different shapes and specifications, weed though the old and to bring forth the new. Ever since the issue of Windows® 98 of the Microsoft® company, this new data transmission interfaces—the USB (Universal Serial Bus) has become a very hot issue.

In reality, the USB specification has gone to the public by Intel® company as 1996, but the operation system at that time did not support the driving function of this interface. The position of this new interface was not definite until the Windows 98 appeared to the market. USB is a specification of a general-purpose interface; it can connect to the peripherals such as the keyboard, the mouse, joystick etc. The connector of the keyboard in the past is a design of a circular one having six pins therein. The mouse has two different connectors having different specifications—a PS2 circular connector and a rectangular connector having 9 pins. This diversified design makes the users create a lot of trouble when it comes to implementing a computer or changing equipments. The function of the USB is to unify these diversified connectors.

The conveniency of the USB relatively results in the seriousness of data let out. Anyone with a portable disc can plug in the USB port of the host computer to steal a copy of the data stored therein. Therefore, a locking device of USB port appeared on the market was developed.

FIG. 1 is an isometric exploded view of the structure of the locking device of a USB port of the prior art. As shown in FIG. 1, the locking device (1) of the USB port on the market of the prior art includes a moving head portion (11), a main body (12), a sliding switch (13), a connecting block (14) as well as two hooks (15). The sliding switch (13) positioned on the main body (12) can move on the first position (91) and the second position (92). The connecting block (14) secures at an end surface of the main body (12) and extends out of the end surface. The two hooks (15) inter-locked with the sliding switch (13) are positioned within the main body (12).

The hook portion (151) of the two hooks (15) is within the connecting block (14) when the sliding switch (13) positions at the first position (91). Therefore, the connecting block (14) can separate from the moving head portion (11), thus make the moving head portion (11) positions at the USB port (not shown in the Figure) to perform the locking of the USB port in order to prevent the data from being read. The hook portion (151) of the hook (15) will extends out of the connecting block (14) as the sliding switch (13) positions at the second position (92). Therefore, the connecting block (14) can connect to the moving head portion (11). By the use of the main body (12) to carry the moving head portion (11) out of the USB port, the USB port can be opened to use.

The above-mentioned locking device of USB port on the market of the prior art has the following demerits: the locking device (1) of a single USB port can perform separation from all the moving head portions (11); thereby, persons who purposely set his mind on doing something can open the moving head portion (11) by simply using a locking device (1) of the USB port to steal the whole data. Therefore, it has been an urgent plan and improvement project for the manufacturers to resolve the above-mentioned problems.

SUMMARY OF THE INVENTION

In light of the above-mentioned demerits of the prior art, the invention provides a locking device of USB port that aims to ameliorate at least some of the demerits of the prior art or to provide a useful alternative.

The primary objective of the invention is to provide a USB copy-resistant plugging-and-locking device that makes use of a alignment portions furnished within the housing of the plugging-and-locking device, and guided slots corresponding to the alignment portions of the USB guided seat (3). Through the changes of the dimension and position of the alignment portions and the guided slots, the efficacy of the formation of cipher code generated by the USB copy-resistant plugging-and-locking device can be achieved.

The secondary objective of the invention is to provide a USB copy-resistant plugging-and-locking device to achieve the locking of the USB port for preventing the data from being stolen by the way that a plugging and locking device is capable of connecting to and separating from the USB port.

In order to achieve the above-mentioned objectives, the invention provides a USB copy-resistant plugging-and-locking device that has an end contacting a USB guided seat, and that is capable of performing displacement movement along the extended direction of the USB guided seat. The USB guided seat has several guided slots, each of the guided slots provides a depth "d" at an end of the USB guided seat, and the several guided slots has at least a dimension specification. The USB copy-resistant plugging-and-locking device includes a housing for containing the USB guided seat, and a plurality of alignment portions positioning on the housing and appearing as a predetermined arrangement. Each of the alignment portions is one-to-one correspondent to the several guided slots making the USB guided seat place into the containing space when the USB copy-resistant plugging-and-locking device performs a displacement movement along the extended direction of the USB guided seat.

The accomplishment of this and other objectives of the invention will become apparent from the following description and its accompanying drawings of which:

DETAILED DESCRIPTION OF THE PREFERRED EMBODIMENT

Figure 1:
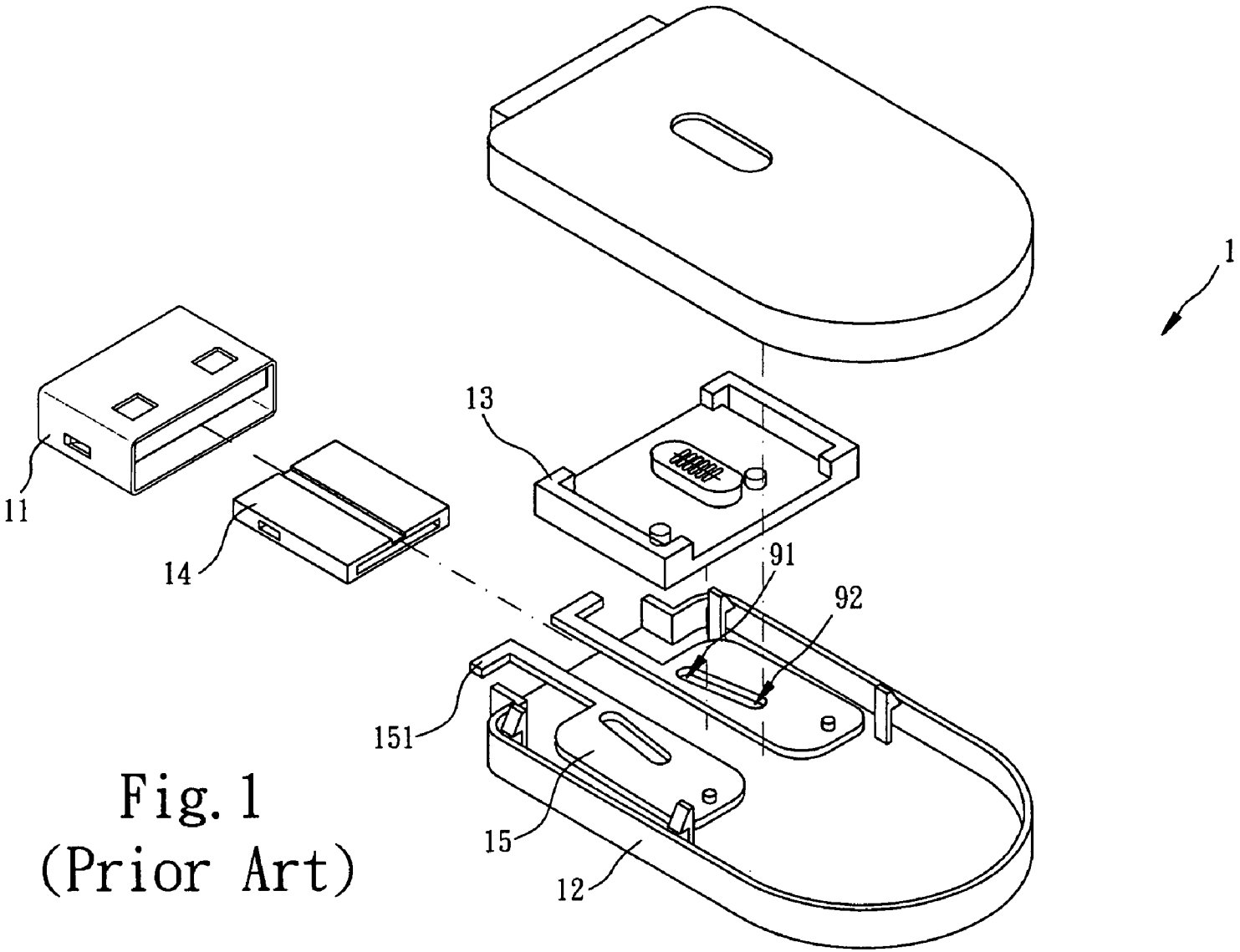
Fig. 1 (Prior Art)
FIG. 1 is an isometric exploded view of the structure of the locking device of a USB port of the prior art.
Figure 2:
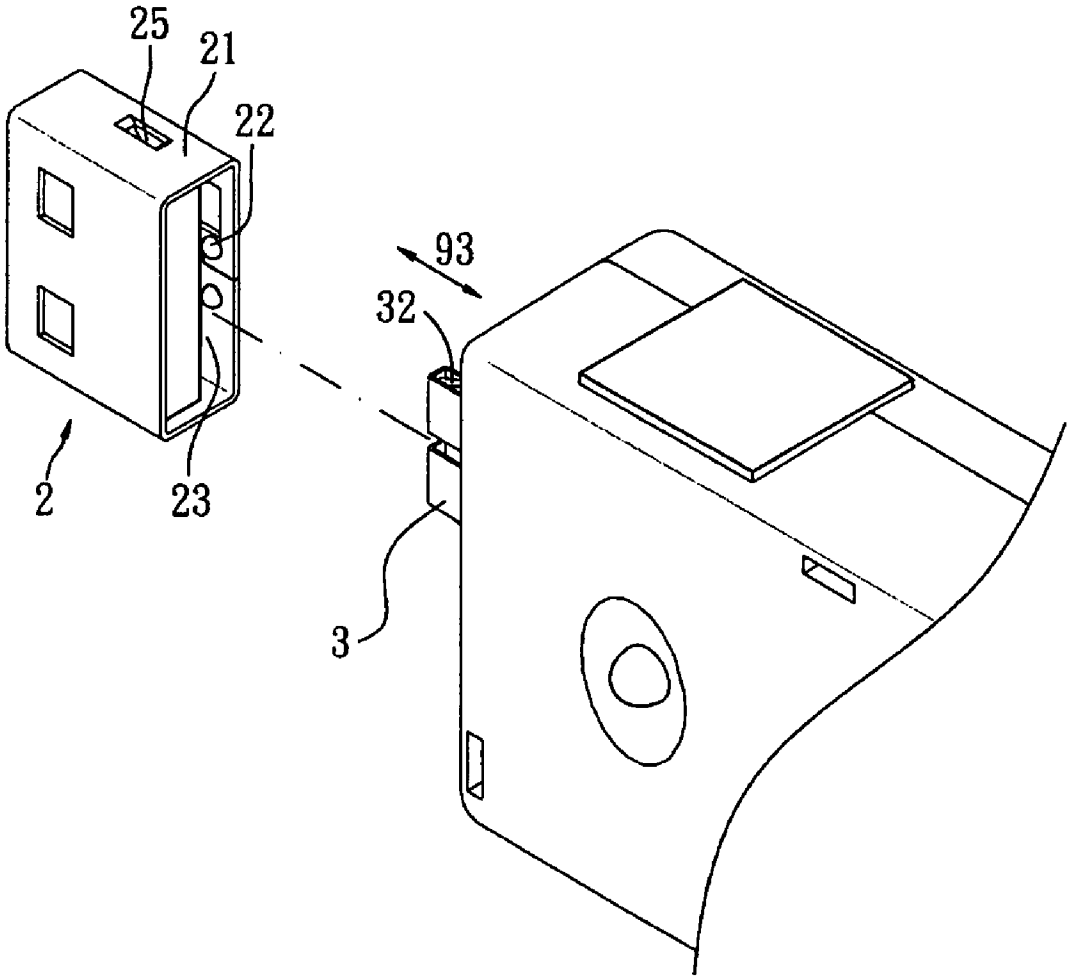
FIG. 2 is an isometric exploded view of the USB copy-resistant plugging-and-locking device of the preferred embodiment of the invention.
Figure 3B:
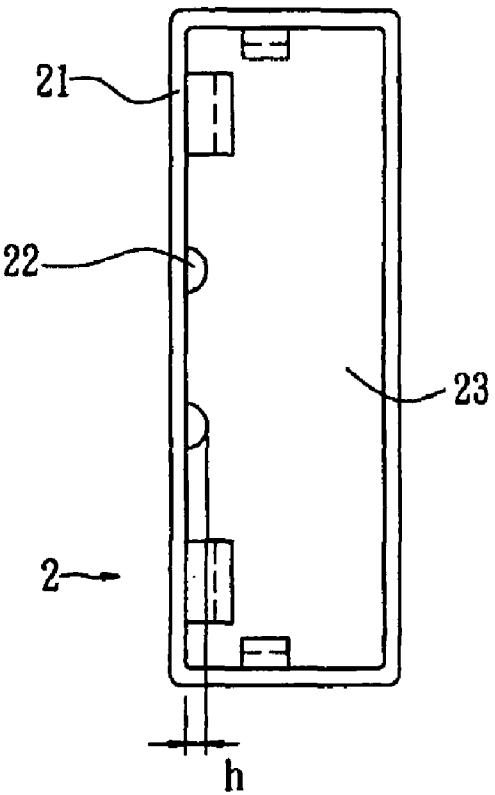
FIG. 3B is a schematic side view of the plug of the USB copy-resistant plugging-and-locking device of the first embodiment of the invention.
Figure 3A:
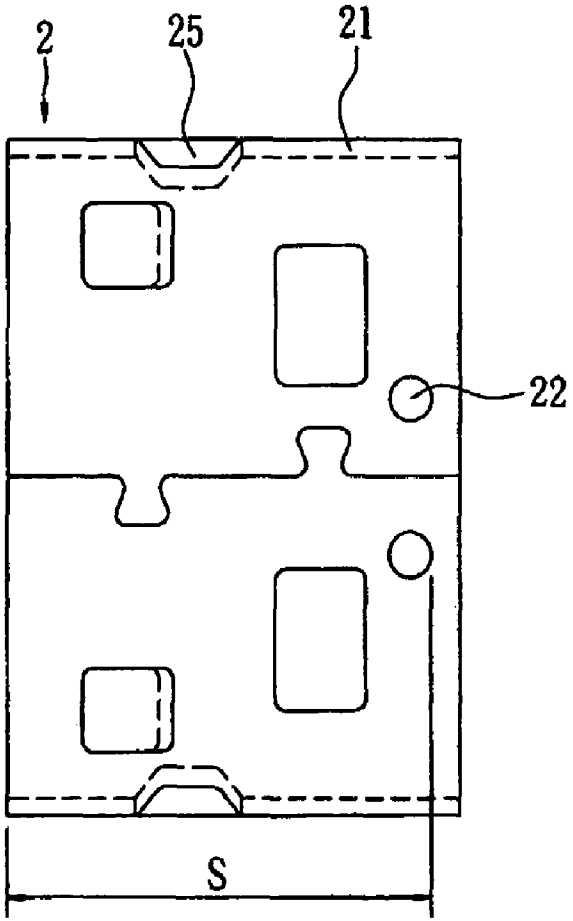
FIG. 3A is a schematic bottom view of the plug of the USB copy-resistant plugging-and-locking device of the first embodiment of the invention.
Figure 3C:
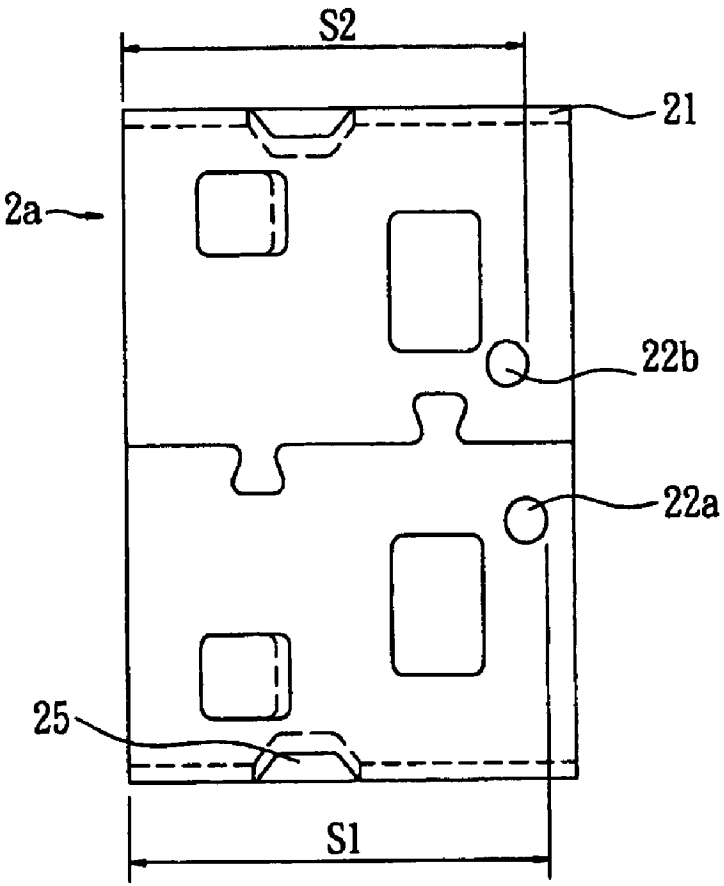
FIG. 3C is a schematic bottom view of the plug of the USB copy-resistant plugging-and-locking device of the second embodiment of the invention.
Figure 4B:
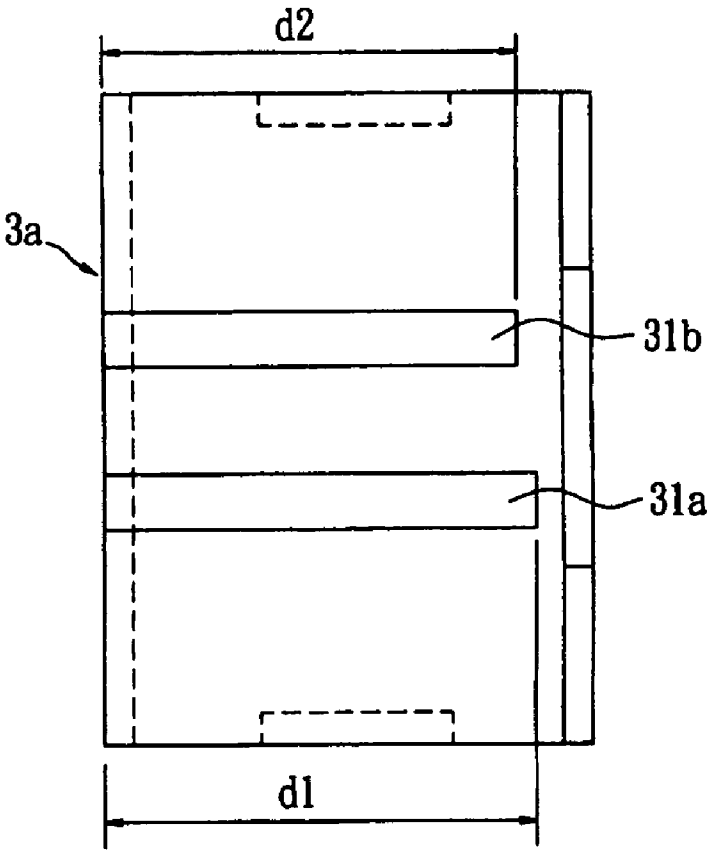
FIG. 4B is a schematic bottom view of the guided seat of the USB copy-resistant plugging-and-locking device of the second embodiment of the invention.
Figure 4A:
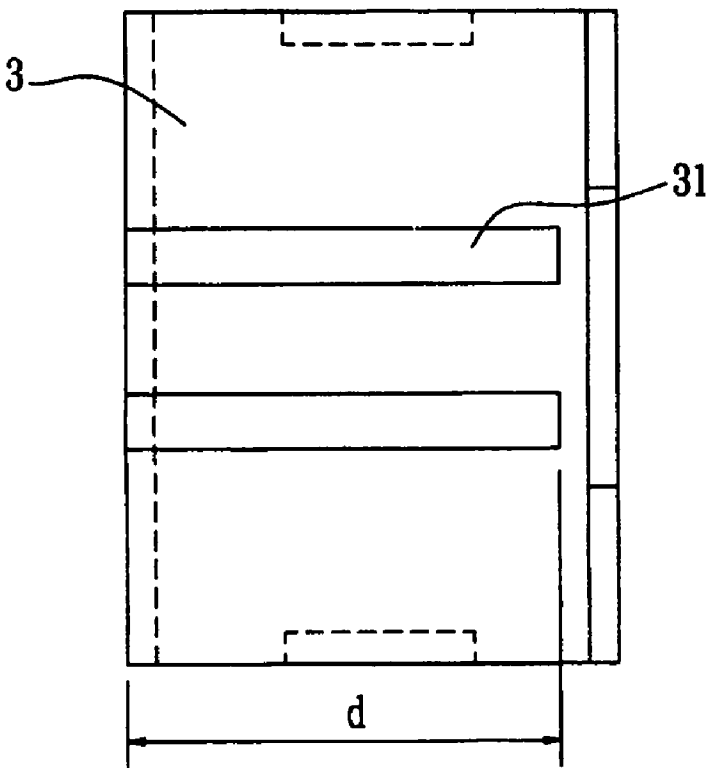
FIG. 4A is a schematic bottom view of the guided seat of the USB copy-resistant plugging-and-locking device of the first embodiment of the invention.

FIG. 2 through FIG. 4A are isometric exploded views of the structure of the USB copy-resistant plugging-and-locking device of the invention. As shown in FIG. 2 through FIG. 4A, an end of the USB copy-resistant plugging-and-locking device (2) can contact a USB guided connector or seat (3) and perform displacement movement along the extended direction (93) thereof, where the USB guided seat (3) possesses several guided slots (31). The USB copy-resistant plugging-and-locking device of the invention includes a housing (21) and a plurality of alignment portions (22). The housing (21) has a containing space (23) for containing the USB guided seat (3) while the plurality of alignment portions (22) are positioned on the housing (21) and having a height "h" extended along the direction of the containing space (23).

In the first embodiment of the invention, the plurality of alignment portions (22) are designed as two thereof, and each of the alignment portions (22) keeps a same distance "s" from an end of the housing (21) while several guided slots (31) are also designed as two thereof, and are one-to-one correspondent to the positions of the alignment portions (22). Each of the guided slots (31) provides a depth "d" at an end of the USB guiding seat (3). The dimension of the distance "s" is set not to be greater than the dimension of the depth "d" for facilitating the placing of the USB guided seat (3) into the containing space (23) when the USB copy-resistant plugging and locking device (2) performs displacement movement along the extended direction (93) of the USB guided seat (3). In other words, the USB guided seat (3) is unable to place the USB guided seat (3) completely into to the containing space (23) if the dimension of the distance "s" is greater than the dimension of the depth "d".

In the second embodiment of the invention, the plurality of alignment portions (22*a*)-(22*b*) are designed as two thereof, and each of the alignment portions (22*a*)-(22*b*) keeps a different distance "s1"-"s2" respectively from an end of the housing (21) while the guided slots (31*a*)-(31*b*) of the USB guided seat (3*a*) are accordingly designed as two thereof, and the depths "d1"-"d2" provided at the ends of each of the guided slots (31*a*)-(31*b*) are different. However, each of the guided slots (31*a*)-(31*b*) is one-to-one correspondent to the positions and distance "s1"-"s2" of the alignment portions (22), thereby, it is capable of completely placing the USB guided seat (3*a*) into the containing space (23). Due to the variation of the position and dimension of the alignment portions (22*a*)-(22*b*) and the guided slots (31*a*)-(31*b*), it is understood that not all the USB guided seat (3*a*) can be completely placed in the containing space (23), and it is for this reason that the USB copy-resistant plugging and locking device (2) of the invention possesses the efficacy of having cipher codes. Certainly, the alignment portions (22) and the guided slots (31) can also be designed as three or more thereof, and it is for these variations that make the invention have even more cipher efficacies.

In the preferred embodiment of the invention, each side of the housing (21) has an open channel (25), and the USB guided seat (3) has the corresponding two hook portions (32) that are capable of connecting to the open channels (25) making the housing (21) combine with the USB guided seat (3) to form an integral body.

It will become apparent to those people skilled in the art that various modifications and variations can be made to the structure of the invention without departing from the scope or spirit of the invention. In view of the foregoing description, it is intended that all the modifications and variation fall within the scope of the following appended claims and their equivalents.

What is claimed is:

1. A USB copy-resistant plugging-and-locking system comprising:

a guided connector comprising:

a first guided slot;

a moving head portion for blocking a USB port, comprising:

a housing having a first end, a second end, and a containing space, wherein the guided connector is inserted into the containing space through the first end, and the first end and the second end are at opposite sides from each other; and a first alignment section positioned inside the housing, wherein the first alignment is correspondent to the first guided slot for inserting the guided connector into the containing space; and wherein the moving head portion is inserted into the USB port to lock the USB port, and the guided connector is inserted into the moving head portion to remove the moving head portion from the USB port.

2. The USB copy-resistant plugging-and-locking system as claimed in claim 1, wherein the first alignment section's height is "h".

3. The USB copy-resistant plugging-and-locking system as claimed in claim 1, wherein the first guided slot's length is "d", the first alignment section is distanced "s" away from the second end; and "s" is not greater than "d".

4. The USB copy-resistant plugging-and-locking system as claimed in claim 1, wherein the housing has a channel, and the guided connector further comprising a securing section connecting to the open channel.

5. The USB copy-resistant plugging-and-locking system as claimed in claim 4, wherein the securing section is a hook.

6. A USB copy-resistant plugging-and-locking system consisted of:

a guided connector consisted of:

a first guided slot;

a second guided slot;

a first hook; and a second hook;

a moving head portion for blocking a USB port, consisted of:

a housing having a containing space, wherein the guided connector is inserted into the containing space;

a first alignment section positioned inside the housing wherein the first alignment is correspondent to the first guided slot for inserting the guided connector into the containing space;

a second alignment section positioned inside of the housing wherein the second alignment is correspondent to the second guided slot for inserting the guided connector into the containing space;

a first opening channel wherein the first opening channel is correspondent the first hook; and a second opening channel wherein the second opening channel is correspondent the second hook; and wherein the moving head portion is inserted into the USB port to lock the USB port, and the guided connector is inserted into the moving head portion to remove the moving head portion from the USB port.

* * * * *